United States Patent [19]

Kollsman

[11] 3,942,199

[45] Mar. 9, 1976

[54] SLIP RESISTANT SURFACES FOR BATHING FIXTURES, SUCH AS BATHTUBS AND SHOWER RECEPTORS

[76] Inventor: Paul Kollsman, 1010 - 5th Ave., New York, N.Y. 10028

[22] Filed: Sept. 10, 1973

[21] Appl. No.: 395,576

Related U.S. Application Data

[63] Continuation-in-part of Ser. No. 221,886, Jan. 31, 1972, abandoned.

[52] U.S. Cl. ..... 4/185 R; 4/146; 4/173 R; 4/185 F

[51] Int. Cl.[2] ..... A47K 3/12

[58] Field of Search ..... 4/173, 185 F, 145, 146, 4/148, 185 R

[56] References Cited

UNITED STATES PATENTS

| | | | |
|---|---|---|---|
| 2,292,368 | 8/1942 | Gordon | 4/146 |
| 2,449,323 | 9/1948 | Richterkessing | 4/146 |
| 2,477,960 | 8/1949 | Caldwell | 4/185 F |
| 2,757,385 | 8/1956 | Whittick | 4/146 |
| 2,809,380 | 10/1957 | Gruen | 4/146 |
| 3,124,811 | 3/1964 | Treacy | 4/173 |
| 3,318,742 | 5/1967 | Holton | 4/146 X |
| 3,363,267 | 1/1968 | Kaiser et al. | 4/146 |

*Primary Examiner*—Henry K. Artis
*Attorney, Agent, or Firm*—Howard G. Russell

[57] ABSTRACT

Bathing fixtures, such as bathtubs and shower receptors and devices such as diving boards and surfboards, are provided with a contoured surface, at least within an area on which a person normally sits or stands, to provide within such area a great number of alternate, raised and depressed surface portions bounded by sharp edges which break down slip-promoting liquid film. The depressions are substantially flat bottomed, very shallow and operate to support a portion of the bather's weight, the portion varying between a lesser weight percentage during the period a bather begins to transfer weight onto the contoured surface, this being the period during which the danger of slipping is greatest, and a greater weight percentage during the subsequent period during which the contoured surface supports the bather's full weight.

9 Claims, 14 Drawing Figures

SLIP RESISTANT SURFACES FOR BATHING FIXTURES, SUCH AS BATHTUBS AND SHOWER RECEPTORS

This application is a continuation-in-part of application Ser. No. 221,886, filed Jan. 31, 1972, now abandoned.

There exists the danger of sliding, falling and consequent injury in bathing fixtures, such as bathtubs and shower receptors. The mechanical cause of this danger is the low degree of friction existing between bare feet or bare skin and the contacted fixture surface in the presence of a liquid film between feet or skin and the fixture surface, respectively.

Danger of slipping likewise exists in the normal use of diving boards and surf boards.

The danger of slipping is aggravated by the presence of soap solution, detergent solution, and oils, such as bath oil, suntan oil, and cosmetic lotion. For example bath oil droplets tend to float on the surface of the water in a bathtub. They adhere to the substantially dry skin of a person stepping into the bathtub and thus form a lubricating film between foot or skin and the tub surface, respectively. Similar conditions of danger are created in shower stalls by soap solution on the receptor floor. In a similar manner suntan oil used by a surfer tends to lessen the friction between his skin and the surface of the surf board.

Attempts to reduce the danger of slipping have been made in the past with varying degrees of effectiveness.

Ceramic bathtubs, and bathtubs made of steel and coated with a vitreous enamel surface, have been provided in the past with a pattern of round-edged depressions and projections of a rather coarse pattern of parallel straight or undulating corrugations. The effectiveness of such contouring is practically nil as regards slip prevention. For this reason the aforesaid manner of contouring must be considered as being merely ornamental.

It is also known to adhere strips or patches of decoratively shaped plastic sheet material to a bathtub or shower receptor bottom. The top surface of this material resembles relatively coarse emery cloth. The bottom surface carries a pressure sensitive coating capable of adhering to a dry bathtub surface.

Such strips or patches increase dry friction materially, but the increase in surface friction in wet condition is demonstrably small. This appears to be due to the fact that surface roughness per se is inefficient in breaking down the slip-promoting liquid film between skin and surface.

For similar reasons the practice of bonding a sand surface to the top surface of a diving board is of only limited effectiveness in slip prevention.

By contrast, the present invention and improvement is based, in part, on the consideration that sharp surface contour edges are capable of breaking down any slip promoting liquid film between skin and fixture surface to create a condition of viscous drag which then reduces the rapid slipping motion to a slow creep, or arrests the motion altogether.

It has been proposed in this connection to provide in bathtubs and shower stalls of a hard plastic material an integral surface pattern of closely disposed parallel channels or grooves. The grooves are round-bottomed, half as deep as they are wide, and are bounded by sharp edges along the lines at which the groove walls meet the top surface.

The provision of sharp edges guards against slipping of the feet, but renders the grooved surface uncomfortable, even painful, to stand or sit on. For this reason the prior proposal includes the provision of smooth ungrooved surfaces at opposite ends of the bathtub upon which the bather may then sit. These smooth surfaces remain slippery and include that area near the tub drain upon which the bather normally stands in a tub-shower installation.

The proposed manner of grooving only a portion of the bathtub bottom limits the area upon which a bather may sit in comfort and the area on which slip resistance is provided.

The present invention aims at eliminating the aforesaid disadvantages.

In this regard the invention is based, in part, on the further consideration that two distinct conditions, or phases, are encountered in the use of a bathing fixture or device and that the change from one condition to the other may be taken advantage of to eliminate the sensation of uncomfortable roughness of the contoured fixture surface under the condition of the full body weight bearing down on the sharp-edged contoured area.

The danger of slipping is greatest during an initial phase during which the bather steps onto the fixture surface. During this phase less than the full body weight bears down on the fixture surface, and the direction of the weight-force comprises a substantial horizontal force component which tends to induce slipping.

During the subsequent second phase the full body weight is transferred onto the fixture surface, whose sharp edges tend to press against the skin with an equal force, but the horizontal force component is greatly reduced and practically nil.

The invention proceeds from the consideration that during the first phase substantially all of the available weight force should act against the sharp contour edges to break down the slip promoting film. This involves no discomfort since firstly the acting force is considerably less than the full body weight and secondly, the skin is not yet softened by a period of water immersion.

During the second phase the skin flexes under the full weight force to conform to the slight elevational differences of the contoured surface, and a substantial portion of the full body weight bears down on, and is supported by, the flat bottomed depressed portions provided according to the invention. The elevational differences, however, are made so slight as to produce no discomfort, in contrast to the aforementioned proposal of the prior art according to which the skin always straddles the grooves and never contacts the groove bottom, which therefore is inoperative to relieve a portion of the weight.

A bathing fixture, more particularly a bathtub or shower receptor, comprising on its surface a plurality of elevated contour elements, which elements have a flat top surface and side surfaces meeting the respective top surface along sharp edges, adjacent elements being spaced by relatively depressed portions, is improved according to the present invention in that the individual depressed portions are substantially flat bottomed, of a depth of not less than 0.1 and not more than 0.8 mm, and of a means width of not less than 0.75 mm, but more than double the respective depth dimension.

In addition to providing slip resistance without discomfort, the specified depth-to-width dimension range offers the further advantages of very low water retaining capacity and consequent easy cleanability and simplicity of production.

In integral fixture construction the contour pattern is readily moldable, in case of molded construction; or is produceable by abrasive blasting or etching, in fixtures having a vitreous enamel surface.

The elevated surface portions may have the shape of parallel undulating or zigzag bands. A band width of the order of 1 to 6 mm and a groove width of the same order of magnitude has been found by tests to be particularly effective and comfortable. The elevated portions may also be of circular, or semicircular e.g. oval shape. Such shapes offer the advantage of substantially equal slip resistance in all directions.

Elevated surface portions surrounded on all sides by depressed portions or grooves form substantially flat-topped islands. Suitable island shapes are circles, ovals, squares, rectangles, parallelograms or any other shape of polygons arranged in straight-line or zigzag sequence.

The objects, features and advantages of this invention will appear more fully from the detailed description which follows accompanied by drawings showing, for the purpose of illustration, preferred embodiments of the invention. The invention also resides in certain new and original features of construction and combination of elements.

Although the characteristic features of this invention which are believed to be novel will be particularly pointed out in the claims appended hereto, the invention itself, its objects and advantages, and a preferred manner in which it may be carried out, may be better understood by referring to the following description taken in connection with the accompanying drawings forming a part of the disclosure.

In the drawings:

FIGS. 1 and 2 are perspective views of a bathtub shell and a shower receptor, respectively, comprising surface areas contoured to provide slip-resistance;

FIGS. 3*a*, 3*b*, 4, 5*a*, 5*b*, 10*a* and 10*b* are plan views of representative contour patterns;

Figure 1:
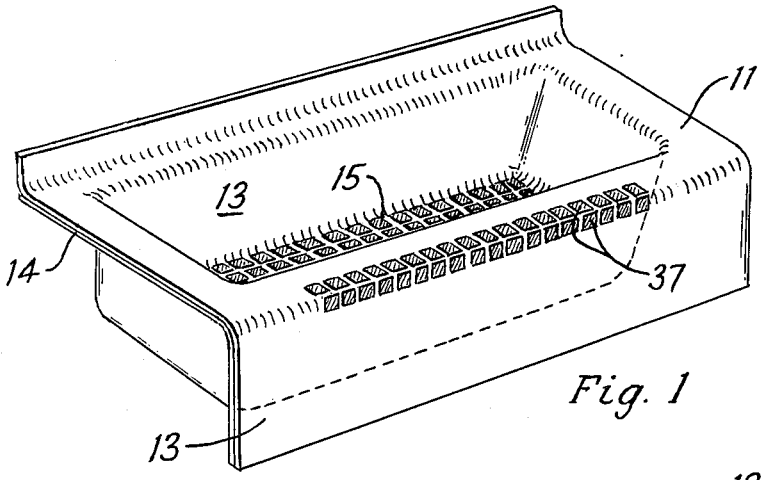

In the following description and in the claims various details will be identified by specific names for convenience. The names, however, are intended to be generic in their application. Corresponding reference characters refer to corresponding parts in the several figures of the drawings.

It is further intended that the term bathing fixture be broadly construed to include fixtures and devices used in the presence of water where slipping of bare skin, particularly bare feet is a potential danger, for example on the top surface of surfboards and diving boards.

The drawings accompanying, and forming part of, this specification disclose certain specific details of construction for the purpose of explanation of broader aspects of the invention, but it should be understood that structural details may be modified in various respects without departure from the principles of the invention and that the invention may be incorporated in other structural forms than shown.

The bathtub 11 and the shower receptor 12 may be constructed of pressed steel or cast iron, coated with a coating of vitreous enamel fused thereto. The fixtures may also be constructed according to known techniques as a reinforced shell structure 13, 14, or which the shell 13 proper is either molded from a sheet of heat-moldable synthetic resin, such as methylmethacrylate or formed as a gel-coat layer of epoxy or polyester resin.

The shell 13 comprises a hard, glossy, wear resistant water carrying forward surface. Its reinforcing layer 14 of suitable material, for example a mixture of glass fibres and a polyester or epoxy resin, increases the total thickness and strength of the molded shell materially.

The surface of vitreous enamel is commonly highly glossy and offers little frictional resistance to bare feet and body skin, especially in the presence of soap solution, detergent solution, bath oil, skin oil, cosmetic lotions, etc.

The forward surface of a molded shell may be even more slippery than a vitreous surface due to the hydrophobic character of the plastic. The danger of slipping is consequently greater.

In order to reduce the danger of slipping and sliding, at least a portion of the forward shell surface is contoured.

Figure 3A:
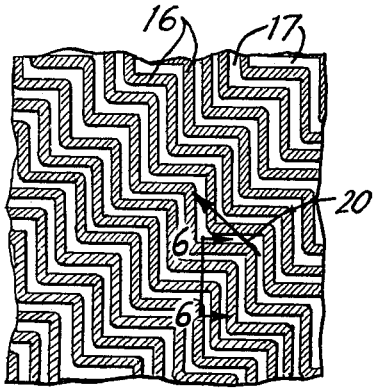

A representative contour pattern is shown in FIG. 3*a* and comprises elevated portions 16 shaped as parallel zigzag bands, separated from one another by zigzag grooves 17 hereinafter sometimes referred to as depressed portions of the pattern. The range of depth of the depressed portions is between 0.1 and 0.8 millimeters.

Figure 3B:
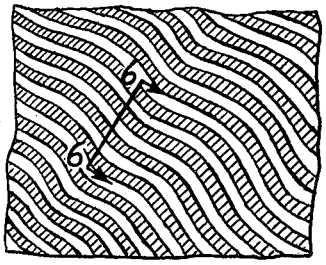

A modification of the relatively sharp-angled zigzag pattern of FIG. 3*a* is shown in FIG. 3*b* in which points and small radii of the zigzag are replaced by small radii and larger radii, respectively, resulting in an undulating pattern.

Figure 6:
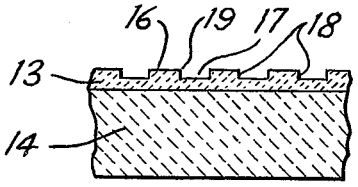
FIG. 6 is a section taken on line 6—6 in FIG. 3.
Figure 9:
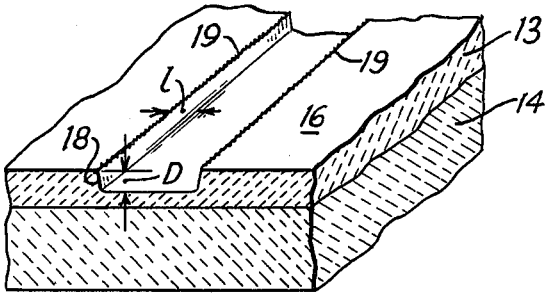
FIG. 9 is an enlarged perspective view of a certain groove shape produced by sandblasting.
Figure 11:
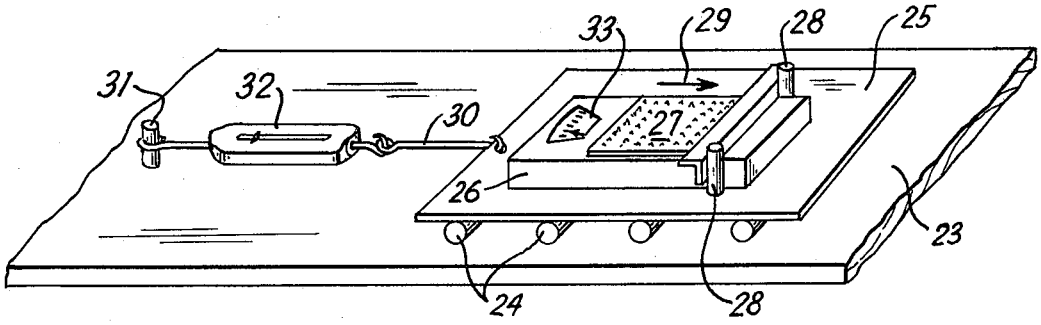
FIG. 11 is a schematic perspective illustration of a representative device for testing the relative effectiveness of different surface contours and materials.

FIG. 6 is a section taken on line 6—6 of FIGS. 3*a* and 3*b*, respectively. The sides 18 of the grooves 17 meet the surface 16 along a sharp edge 19, (see FIG. 9) which, as hereinafter pointed out, may be of serrated character in the event the pattern is produced by abrasive blasting, such as sandblasting. As will later be pointed out, the angle between the groove side 18 and the top surface 16 may deviate from a right angle for reasons of manufacture. The depressions 17 are entirely or predominantly formed in the surface layer or shell 13, and the layer 14 forms backing or support for the shell.

Figure 2:
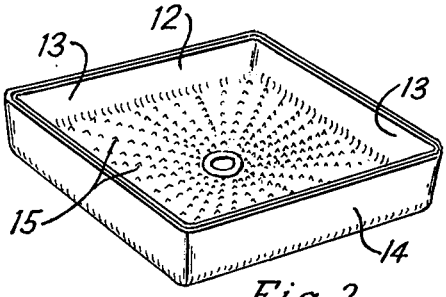

In the pattern of FIGS. 3*a* and 3*b* the grooves 17 extend predominantly in the direction of the arrow 20. In actual use of the fixture this direction is suitably aligned with the direction in which water drains. Similarly, in the shower receptor of FIG. 2 the pattern of the contour is substantially radial to facilitate drainage to the center.

Figure 4:
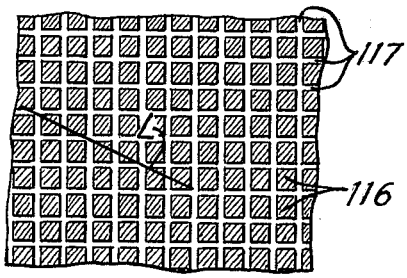

The pattern of FIG. 4 comprises a gridwork of grooves 117 which intersect each other at right angles. The horizontal grooves may be considered as forming one group disposed transverse with respect to the second group of vertical grooves. The elevated portions 116 are correspondingly square-cornered islands. This pattern furnishes two directions suitable for drainage.

Figure 5A:
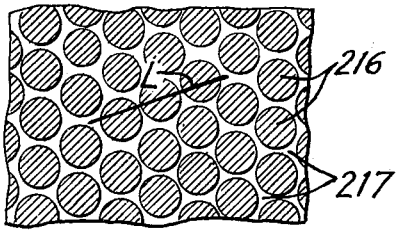

The elevated portions 216 of the pattern of FIG. 5*a* are circular islands, and the depressions 217 therebetween may be considered as extending in three directions. Obviously, the elevated portions would become hexagonal, if the grooves were parallel-sided.

Figure 5B:
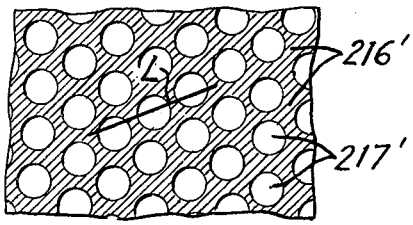

The pattern shown in FIG. 5*b* comprises circular depressions or cavities 217', the cavities being surrounded by elevated portions 216'.

The manner of generating the depressions depends on the material. Assuming the layer 13 in FIG. 7 consists of a ceramic, vitreous material, suitable manners of producing depressions include etching and abrasive blasting, for example sandblasting, of the surface after application of an appropriate mask 21 resistant to etching fluid or an abrasive blast.

The bottom and/or the sides of the depressed portions 17 may optionally be coated with an appropriate material, such as epoxy resin or silicone rubber to produce a smoother finish, or a finish having desirable surface properties such as hydrophobic properties, or a contrasting color for decorative reasons. This is shown in the right hand portion of FIG. 7 at 22.

A resinous surface of sufficient hardness may also be contoured by abrasive blasting through an appropriately shaped mask. For the sandblasting operation the synthetic plastic material may be temporarily refrigerated to increase its hardness and brittleness.

In the event the depressed portions are produced in a resinous material by molding, it is of advantage to incorporate a slight taper to the sides of the mold, as indicated by the angle$\alpha$. Assuming the angle $\alpha$ is of the order of 10°, then a wall slope $\beta$ of 80° results which facilitates withdrawal of the molded elevated portions from the corresponding depressed portions of the mold by which the elevated portions are shaped.

The magnitude of the angle $\beta$ is of lesser importance than the sharpness of the edges 19. The term sharpness is difficult to define but, as a practical matter, it was found that a molded edge having a radius of the order of one-tenth of a millimeter is sufficiently sharp for the purposes of this invention. However, radii of the order of one-half of a millimeter produce satisfactory results.

Figure 10A:
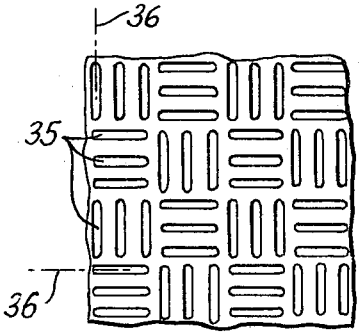
Figure 10B:
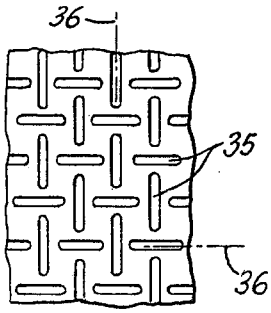

FIGS. 10*a* and 10*b* illustrate a pattern of elongated contours 35 having an axis of elongation 36, the axes of elongation of certain contours extending in one direction, and the axes of elongation of other contours being disposed at an angle to said one direction.

The contours of FIG. 10*a* are arranged in groups of three, the direction of the axes of elongation of the groups differing by 90° and alternating from group to group. The direction of the axes of elongation of the single contours 35 of FIG. 10*b* alternate.

Both patterns provide excellent resistance to sliding in all directions.

A representative dimension for the elongated contour is a length of 14 mm. and a width of 2 mm.

Several patterns with contours according to FIGS. 5*a* and 5*b* were produced as follows:

EXAMPLE 1

Resinous material (methylmethacrylate) was molded to produce a pattern of elevated islands 215 having flat top surfaces of 4.5 mm. diameter, the islands being spaced 6 mm. from center to center. The depressed portions, surrounding the islands on all sides, had a depth of 0.5 mm. The sides of the islands had a taper of ten degrees, resulting in a 100° angle between sides and top of the islands.

EXAMPLE 2

A second pattern was produced corresponding to that of Example 1 in all particulars, except that the tops of the islands were slightly dished, resulting in an angle between top and sides of 92°.

Tests showed satisfactory slip resistance for both patterns, but slightly superior performance of the second pattern.

EXAMPLE 3

A vitreous ceramic surface was sandblasted to produce circular islands of a diameter of 4.5 mm., spaced 6 mm. from center to center, the depth of the depressed portions being 0.5 mm.

EXAMPLE 4

A vitreous ceramic surface was sandblasted to produce circular flat bottomed cavities of a diameter of 4.5 mm. and a depth of 0.5 mm., the cavities being spaced 6 mm. center to center.

In Examples 3 and 4 the sandblasted depressed portions were sprayed with an epoxy resin paint through the sandblasting masks to produce a coating of approximately 0.1 mm. thickness on bottom and sides.

The contoured areas of Examples 3 and 4 were found to provide an extraordinary high degree of slip resistance. Microscopic inspection showed that the edges had a serrated appearance, due presumably to the action of the abrasive particles which operate to chip away small chips of vitreous material, each removed chip leaving a sharp edge at its place of removal.

The resinous coating of bottom and sides of the cavities was found not to diminish the effectiveness of the sharp edges.

EXAMPLE 5

In a vitreous surface a contour similar to FIG. 3*a* was produced by photoetching after application of a layer or mask 21 impervious to the etching liquid. The width of the zigzag band (16, FIG. 3*a*) was 0.75 mm., the depth of etching was 0.1 mm. The slip resistance and seating comfort of the pattern thus produced was good.

EXAMPLE 6

A contour of the pattern illustrated in FIG. 5*a* was produced in a vitreous surface by etching. The islands 216 measured 2.25 mm. in diameter, their spacing, center to center, was 3 mm. and the depth of etching was 0.1 mm. The seating comfort and the slip resistance of the pattern of this example was good.

In order to test the performance and effectiveness of the invention, panels of different materials bearing different contour configurations were compared with one another and with a smooth non-contoured panel under different conditions.

Contour configurations were also compared with respect to overall area smoothness to determine the degree of relative comfort or discomfort of a person sitting, or standing on it. Further comparative observations of relative comfort were made of a person leaning on the surface with a forearm where tissue padding between skin and bone is relatively thin, even nonexistant.

A test device for determining surface friction is shown in FIG. 10 and comprises a steel base 23 on the smooth surface of which rollers 24 support a carriage plate 25. The plate 25 carries a weight scale 26 on which sample plates 27 rest against a stop 28. The stop 28 is fixed with respect to the carriage plate 25.

The carriage 25 may be pushed in the direction of the arrow 29, but is restrained by a cable 30 secured to a post 31 and containing a spring scale 32 to determine the force exerted during an effort of displacing, i.e., pushing the sample plate 27 in the direction of the arrow.

In a representative test a hand or a suitable test pad is placed on the sample 27 with a weight force readable at the weight scale window 33. An effort is then made to push the sample in the direction 29, and the pull on the cable 30 is determined at the moment the skin surface begins to slide on the sample surface under test.

Test series were made as follows:

1. Surface of sample plate wetted by soap solution.

2. The surface of the sample plate was water wet. A dry hand or test pad was immersed in a pan of water to which bath oil was added, then placed on the water wet sample plate surface. In this test oil droplets adhered to the dry skin or pad surface in preference to water. The oil droplets then formed a lubricating film which, unless broken, promotes sliding. This test simulates the conditions encountered by a person stepping into a bathtub filled with water to which bath oil was added.

3. The surface of the sample plate was moistened by cosmetic oil and contacted by dry skin and, conversely, the surface of the sample plate was dry and the skin was coated with a film of cosmetic oil.

The load figures and the pull figures are given in English pounds. The resulting motion of the skin surface relatively to the surface was noted and classified as follows: (a) slow creep, meaning a slow motion at a substantially constant rate; (b) accelerating creep, meaning a motion gradually accelerating in velocity, but slow enough to be called controllable; and (c) accelerating skid, meaning a motion so sudden and so quickly accelerating as to be uncontrollable. It represents the kind of motion likely to result in a fall.

Molded plastic surfaces of the following contours were compared in a first series of tests:

a. a smooth surface, b. parallel ridges (see FIG. 8) saw-tooth shaped in cross section and of a slope of 45°, the radius of curvature at the ridge peaks being of the order of 0.6 millimeters, c. zigzag grooves (see FIG. 3*a*) in which the groove width was 1.5 mm., the groove depth was 0.8 mm. and the width of the flat weight supporting surface was 3 mm.

Table 1

Soap solution on surface

Figure 8:
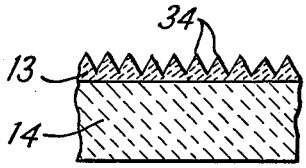
FIG. 8 is a sectional view of a comparison contour.

| Surface | Load | Pull | Motion |
|---|---|---|---|
| Smooth | 10 | less than 1 | accelerating creep |
| | 20 | less than 1 | accelerating skid |
| | 40 | about 1 | accelerating skid |
| FIG. 8 Contour | 10 | 2.5 | slow constant rate creep |
| | 20 | 4 | slow accelerating creep |
| | 40 | 6.5 | accelerating creep |
| FIGS. 3a; 6 Contour | 10 | 3.5 | slow constant rate creep |
| | 20 | 5.5 | slow constant rate creep |
| | 40 | 7 | slow constant rate creep |

Table 2

Surface wet, skin dipped in water containing bath oil

| Surface | Load | Pull | Motion |
|---|---|---|---|
| Smooth | 10 | less than 1 | skid |
| | 20 | 2 | accelerating skid |
| | 40 | 3.5 | " |
| FIG. 8 | 10 | 2 | accelerating creep |
| | 20 | 4 | " |
| | 40 | 7 | " |
| FIGS. 3a; 6 | 10 | 2.5 | slow constant rate creep |
| | 20 | 5 | " |
| | 40 | 7.5 | " |

Table 3

Surface covered with cosmetic oil, skin dry. Also skin covered with film of cosmetic oil, sample surface dry

| | | | |
|---|---|---|---|
| Smooth | 10 | 3 | accelerating skid |
| | 20 | 5.5 | " |
| | 40 | 8 | " |
| FIG. 8 | 10 | 6 | rapidly accelerating skid |
| | 20 | 12 | " |
| | 40 | 24 | " |
| FIGS. 3a; 6 | 10 | 6.5 | slow constant rate creep |
| | 20 | 15 | " |
| | 40 | 27 | " |

The tests indicate that a saw-tooth pattern promotes accelerated skidding, once a motion commences. A reasonable explanation of this behavior appears to be that under a condition of rest the ridge peaks tend to squeeze out films of liquid existing between the ridge of the saw-tooth profile and the skin. During the condition of rest the skin is slightly depressed into the valleys between the ridges, in which valleys liquid is present. As soon as a motion commences the skin wipes films of liquid up the slopes of the contour, thus forming lubricating films which then promote skidding. The skid rate increases rapidly, as the liquid film is self-renewing from the liquid contained in the valleys.

By contrast, the sharp edges of the pattern of FIG. 6 tend to scrape liquid film from the skin surface at each edge. The vertical groove walls do not promote the carrying of liquid films upwardly. Existing liquid films are reduced, or broken, before reaching the load bearing flat top surface of the contour. If a film of liquid initially exists between the skin and the flat weight supporting surface, a slight motion of the skin relatively to the sharp edges causes the liquid film to be greatly reduced or broken.

A second test series was conducted with ceramic material having a glazed surface in which two zigzag patterns of the form shown in FIGS. 3 and 6 were cut by sandblasting and on which a separate roughened non-grooved surface was produced for comparison by sandblasting of the originally flat glazed surface. The dimensions of the zigzag pattern were as follows: groove width 1.5 mm., groove depth 0.75 mm., zigzag band surface width 5 mm. Due to differences in masking, a first zigzag pattern had somewhat dulled edges of a radius of the order of 0.5 mm. at an edge angle of about 135°. A second sharper zigzag pattern produced with the aid of a thinner mask had relatively sharp edges of an edge radius of less than 0.2 mm. at an edge angle of about 100°.

Table 4

| | | | Oil | Soap Solution | |
|---|---|---|---|---|---|
| (a) | sharp edged zigzag (FIG. 3a) | 10 | 4 | 10 | 1 |
| | | 20 | 8 | 20 | 2 |

Table 4-continued

| | | | Oil | | Soap Solution |
|---|---|---|---|---|---|
| (b) | dull edged zigzag (FIG. 3a) | 10 | 2 | 10 | less than 1 |
| | | 20 | 5 | 20 | 1 |
| | | 40 | 9 | 40 | 2.5 |
| (c) | entire surface sandblasted (no pattern) | 10 | 1.2 | 10 | less than 1 |
| | | 20 | 4.5 | 20 | 1 |

In Table 4 the first figure in each column represents load, the second figure pull. In tests 4*a* and 4*b* the resulting motion was a controlled sliding motion of a constant, or only slightly increasing, rate. In tests 4*c* the resulting motion was an accelerated skid.

Figure 7:
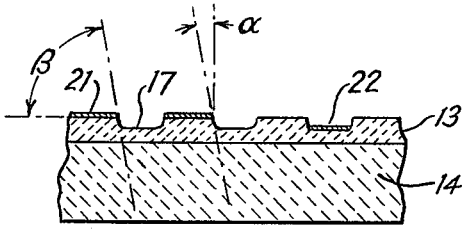
FIG. 7 is a representative sectional view illustrating certain details.

Samples *a* and *b* of test 4 differed in the depth and angularity of the groove walls, a result of the specific masking and sandblasting techniques employed. The contour of sample *a* corresponded to the shape indicated in FIG. 6. In sample *b* the groove was somewhat trough-shaped as shown in FIG. 7. The sloping sides 18 produced an edge 19 which feels somewhat blunt to the touch. The ability of this edge to remove or reduce liquid film is impaired to a degree.

Without limiting the merits of the present invention by theories regarding, or explanation of, its operation the following appears to be a reasonable explanation:

Under slight motion of the skin relatively to the edge 19 the existing liquid film, which may contain soap solution or oil, is either broken or greatly reduced in thickness. If broken, the resulting friction approaches solid-to-solid friction. Assuming, on the other hand, that the film is only reduced in thickness, the remaining film is very thin and the friction encountered between skin and the flat surface portion 16 is of the nature of viscous friction under which twice the force is required in order to produce twice the sliding velocity, three times the force for three times the velocity, and so forth.

By way of contrast a pattern of the type shown in FIG. 8, and incorporated in certain rubber mats of the prior art is unfavorable because flat supporting surface areas are lacking on which viscous friction could act to retard the rate of motion, quite apart from the inherent undesirable property of a saw-tooth contour of permitting liquid to be wiped upwardly on the groove walls, thus establishing, rather than diminishing, a skid promoting formation of a liquid film.

The tests suggest that the danger of skidding and falling on a ceramic surface is greater in the presence of soap solution, and somewhat less in the presence of oil than on a comparable surface of a resinous plastic.

Tests were conducted to determine whether, and if so, to what extent, the anti-skid action of the edges of the elevated contour elements is dependent on changes in the depth of the depressed portions therebetween.

For this purpose round bottomed grooves of the prior art having a depth-to-width ratio of two to one were compared with flat bottomed grooves of equal width, but very small depth dimension as disclosed in this specification.

A leather-covered test pad closely resembling the characteristics of human skin was placed on sample plates bearing the respective test contours. Plates of various groove widths were employed, the grooves being spaced 12.5 mm. center to center so that in all instances the test pad covered the same number of grooves, contacting the same number of edges. A load of 15 and 30 pounds was applied to the pad and the pull was determined at which slippage between pad and contour plate commenced. The slip test was conducted in dry condition.

Table 5

| Load (pounds) | Groove | Pull (pounds) | | | | | | | | | |
|---|---|---|---|---|---|---|---|---|---|---|---|
| | Width | 1.5 | 1.5 | 2.25 | 2.25 | 3 | 3 | 4.5 | 4.5 | 6 | 10 |
| | Depth (mm) | 0.75 | 0.25 | 1.125 | 0.3 | 1.5 | 0.35 | 2.25 | 0.4 | 0.4 | 0.4 |
| 15 | | 3 | 3 | 4.5 | 4.5 | 5.5 | 5.5 | 8 | 8 | 9.5 | 9 |
| 30 | | 6 | 6 | 9 | 9 | 11 | 10.5 | 16 | 14 | 14 | 13 |

The tests show that slip resistance, in other words friction, is substantially unaffected by a change in groove depth at test loads corresponding to the loads placed on one foot when a bather steps onto the surface before placing the entire body weight thereon, this being the moment at which the danger of slipping is the greatest.

The tests further show that the friction encountered is substantially proportional to the weight so that about double the friction is encountered when the load is doubled.

Unexpected however was the discovery that very shallow grooves provide substantially the same degree of friction as deep grooves. Characteristic of deep grooves is that the skin, or test pad, does not contact the groove bottom which therefore carries no portion of the load. Characteristic of the shallow flat bottomed grooves is that, due to skin elasticity, the skin contacts the groove bottom, thereby partially relieving load pressure on the edges. This, as will be shown further below, affects the comfort, and it was unexpected — anticipating the results detailed further below — that a high degree of slip resistance is obtainable without discomfort caused by a sensation of sharp edges pressing into the skin with considerable force.

The test further shows that grooves of the range of 3 to 10 mm. produce a high degree of friction in combination with a high degree of weight support by their flat bottomed depressions. The tested 6 mm. groove has a width of 15 times its depth, a ratio at which, as is self evident, a considerable portion of the skin flexes into contact with the bottom.

The relative comfort, as affected by the depth of the depressions, was determined as follows:

More than one half of an average person's body weight, about 90 pounds, was exerted on one foot, by an appropriate shift in weight from one foot onto the other. The heel of the foot carrying 90 pounds was then slightly twisted to produce a motion across the grooves thus "feeling the roughness" of the contour.

It has found that grooves of 1.5 mm. width and 0.75 mm. depth were comfortable to a person of average skin sensitivity.

A groove of 2.25 mm. width and 1.125 mm. depth was considered rough and uncomfortable.

A groove of 3 mm. width and 1.5 mm. depth was considered too rough for comfort and not acceptable for a person of tender skin.

A groove of 4.5 mm. width and 2.25 mm. depth cut the skin and produced a sensation of pain.

All the shallow grooves of Test 5 were considered comfortable by persons having tender skin. The sensation of their "roughness" was less in all cases than that of the 1.5 mm. wide 0.75 mm. deep groove which was the narrowest tested.

It is concluded on the basis of Test 5 and the roughness test that the shallow flat bottomed grooves are self regulating in the sense that a person stepping onto the surface and before transferring the entire body weight thereon exerts, for a moment, nearly all of the body weight portion against the edges, thereby producing a high degree of anti slip action or friction while the skin is still unflexed. This checks slipping. Shortly thereafter the skin flexes into contact with the shallow flat surface of the depressed portions which then carry a portion of the total body weight thus relieving a portion of the weight pressure on the edges under the action of the full body weight.

In order to operate effectively the slip-preventing edge would be distinct and sharp. Such an edge is deemed to exist where the depth D (FIG. 9) measured within a distance l of not more than 0.4 mm. from the edge 19 is at least 0.1 mm. below the substantially flat surface 16 of the respective elevated portion. Serration of this edge, for example by its generation by abrasive blasting enhances the action or operation of the edge.

In many cases it is desirable to provide a slip resistant surface on portions of a bathtub other than its bottom. As indicated in FIG. 1 at 37, a slip resistant area may be provided on the top portion of the bathtub to provide a secure handhold.

The invention is of equal benefit as applied to athletic water sports devices such as surfboards on which a surfer either stands or lies, or diving boards in the use of which non-slipping of the feet is a primary consideration. Somewhat similar to surfboards are miniature sail boats lacking a cockpit.

What is claimed is:

1. A bathing fixture, more particularly a bathtub or shower receptor, or a water sports device, such as a surf board or diving board, comprising on its surface a plurality of elevated elements, said elements being contoured to have a flat top surface and side surfaces meeting the respective top surface along sharp edges, adjacent elements being spaced by relatively depressed, substantially flat-bottomed, portions, the depth of said depressed portions relatively to said top surface being not less than 0.1 and not more than 0.8 mm, the mean width of said depressed portions, taken individually, being not less than 0.75 mm., but in excess of double the respective depth dimension, whereby initially the user's body weight is caused to act on said sharp edges, whereafter, due to skin flexing, a portion of the weight is transferred to the bottom of said depressed portions.

2. A fixture or device as defined in claim 1 in which, per area unit, the total area of said top surfaces exceeds the total area of said depressed portions in said area unit.

3. A fixture or device as defined in claim 1 in which, the elevated contour elements are islands whose maximum dimension, measured across the island in any direction, is greater than the minimum spacing of adjacent islands.

4. A fixture or device as defined in claim 1 in which the elevated elements are undulating bands parallel to one another.

5. A fixture or device is defined in claim 1 in which the elevated elements are zigzag bands parallel to one another.

6. A fixture or device as defined in claim 1 in which the elevated elements are substantially circular in plan view.

7. A fixture or device as defined in claim 1 in which the fixture surface is composed of vitreous material, in which the sides of said depressed portions have a rough, nonglossy finish, and in which the depressed portions have a layer of resinous material bonded to the bottom thereof.

8. A fixture or device the water carrying surface of which is composed of vitreous material and comprises a contoured surface area comprising alternating area portions of two kinds, one kind being etched to form a substantially flat bottomed depression of a depth of not less than 0.1 and not more than 0.8 mm in relation to the area portions of the other kind, the mean width of said etched portions, taken individually, being not less than 0.75 mm, but at least double the respective depth dimension, the sides of said etched portions meeting the top surface of the portions of the other kind along sharp edges, whereby initially the user's body weight is caused to act on said sharp edges, whereafter, due to skin flexing, a portion of the weight is transferred to the bottom portion of said depressions.

9. A bathing fixture the water carrying surface of which is composed of vitreous material and comprises a contoured surface area comprising alternating area portions of two kinds, one kind being abrasively blasted to form a substantially flat bottomed depression of a depth of not less than 0.1 mm and not more than 0.8 mm in relation to the area portions of the other kind, the mean width of said abrasively blasted portions, taken individually, being not less than 0.75 mm, but at least double the respective depth dimension, the sides of the abrasively blasted portions meeting the surface of the portions of the other kind along sharp edges characterized by the removal of chips of vitreous material having sharp fracture edges, whereby initially the user's body weight is caused to act on said sharp edges, whereafter, due to skin flexing, a portion of the weight is transferred to the bottom portions of said depressions.

* * * * *